US006129347A

United States Patent [19]

Brooks et al.

[11] Patent Number: 6,129,347

[45] Date of Patent: Oct. 10, 2000

[54] ENTRANCE GUIDE FOR FRICTION/ RETARD FEEDING SYSTEMS

[75] Inventors: Janice S. Brooks, Fairport; John D. Gramlich, Webster; Thomas P. Lambert, Webster; Dean Thomas, Webster; Michael J. Diehl, Rochester; James T. Kayko, Lima; Gregory N. Carpenter, Springwater, all of N.Y.

[73] Assignee: Xerox Corporation, Stamford, Conn.

[21] Appl. No.: 09/253,973

[22] Filed: Feb. 22, 1999

[51] Int. Cl.[7] ..... B65H 3/30; B65H 3/52; B65H 1/08

[52] U.S. Cl. ..... 271/22; 271/122; 271/126

[58] Field of Search ..... 271/21, 22, 126, 271/122, 170

[56] References Cited

U.S. PATENT DOCUMENTS

| | | | |
|---|---|---|---|
| 5,052,673 | 10/1991 | Tokuda et al. | 271/22 |
| 5,096,182 | 3/1992 | Kashimura | 271/170 |
| 5,108,084 | 4/1992 | Ishikawa et al. | 271/9 X |
| 5,421,569 | 6/1995 | Davidson | 271/199 |
| 5,695,182 | 12/1997 | Sekine | 271/9.09 X |
| 5,709,380 | 1/1998 | Petocchi et al. | 271/125 |
| 5,769,410 | 6/1998 | Davidson et al. | 271/109 |

*Primary Examiner*—Joseph E. Valenza
*Assistant Examiner*—Kenneth W Bower
*Attorney, Agent, or Firm*—John M. Kelly

[57] ABSTRACT

A substrate feeding system, and printers that use such feeding systems, that includes a feed roll and a retard roll that form a nip, a nudger roll for advancing a substrate from a substrate stack toward the nip, and an entrance guide between the nudger roll and the nip. The entrance guide has a contact surface that forms an angle of more than 100° with the direction of motion of the substrate. The entrance guide further including a top section over which the substrate moves as it advances into the nip. The entrance guide is beneficially pivotally mounted such that when a retard roll is removed the entrance guide pivots out of the way, and such that when a retard roll is in place the entrance guide moves into position.

18 Claims, 3 Drawing Sheets

FIG. 3
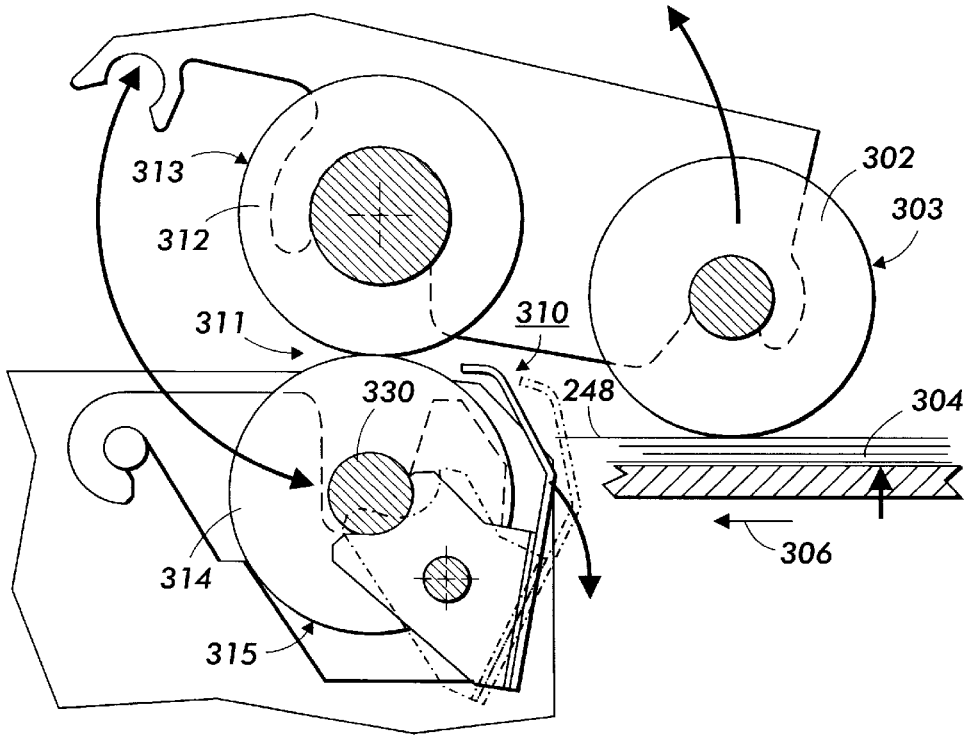
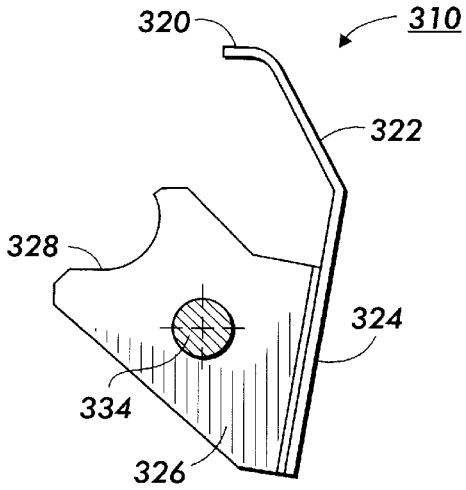
FIG. 4

ENTRANCE GUIDE FOR FRICTION/ RETARD FEEDING SYSTEMS

FIELD OF THE INVENTION

This invention generally relates to substrate (paper) feeders. It more particularly concerns a novel cut sheet substrate feeder entrance guide that performs pre-shingling and that reduces retard roll stalling while enabling the use of a customer replaceable feed cartridge.

BACKGROUND OF THE INVENTION

Electrophotographic marking is a well-known, commonly used method of copying or printing documents. Electrophotographic marking is performed by exposing a charged photoreceptor with a light representation of a desired document. In response the photoreceptor discharges, creating an electrostatic latent image of the desired document on the photoreceptor's surface. Toner particles are then deposited onto that latent image, forming a toner image. That toner image is then transferred from the photoreceptor onto a substrate, such as a sheet of paper. The transferred toner image is then fused to the substrate, usually using heat and/or pressure, thereby creating a permanent image. The surface of the photoreceptor is then cleaned of residual developing material and recharged in preparation for the production of another image.

Marking machines typically include one or more substrate feeding systems. For example, a substrate feeding system might move paper from an input tray to a transfer station. A prior art substrate feeding system 110 is illustrated in FIG. 1. A nudger roll 112 having a high friction surface 114 selectively rotates in the direction 116. The nudger roll 112 is located above a substrate stack 120 that is biased upward by a spring 122. The substrate stack is comprised of individual substrates (such as paper, Mylar sheets, or cardboard). The topmost substrate 124 advances in the direction 126 when the nudger roll rotates. The substrate feeding system 110 further includes a driven feed roll 128 having a high friction surface 129 and a retard roll 130 having a high friction surface 131 that form a nip in the path of the topmost substrate 124. The feed roll rotates in the direction 134 and drives the retard roll in the direction 136. When the topmost substrate reaches the nip the high friction surface 129 grabs the topmost substrate and advances it in the direction 126. If a second substrate is attached to the topmost substrate, such as by friction or electrostatic forces, the retard roll causes the second substrate to separate from the topmost substrate as the feed roll advances the topmost substrate. Thus, the nudger roll, feed roll, and retard roll act to feed individual substrates from the substrate stack 120 in the direction 126.

While prior art substrate feeding systems such as illustrated in FIG. 1 have been very successful they have their problems. For example, eventually the various rolls must be replaced because of wear. Thus, it is highly desirable to have rolls that are easily replaced, either by a service technician or by an end user. See, U.S. Pat. No. 5,421,569 entitled "Replaceable Feed/Retard Roll Unit," inventor Davidson, issued on Jun. 6, 1995.

Other problems with prior art substrate feeding systems include retard roll stalling and multiple sheet feeding. If sheets are sufficiently stuck together the feed-roll/retard-roll separation process may not be sufficient to separate the sheets. In that case multiple sheets may pass through a substrate feeding system. The result can be detrimental machine performance, wasted paper, and undue wear. If many sheets stick together the substrate feeding system may jam. This typically results in an unhappy end user. Furthermore, an expensive and time consuming service call may be required. As marking speeds increase these problems become more critical.

Therefore, an improved substrate feeding system characterized by fewer multiple sheet feedings and reduced staging would be beneficial. Even more beneficial would be a simple pre-shingling/anti-jamming mechanism within a substrate feeding system.

SUMMARY OF THE INVENTION

The principles of the present invention provide for an improved substrate feeding system characterized by fewer multiple sheet feedings and reduced retard roll stalling and fewer machine shutdowns due to a reduction in timing delays caused by sheet-to-sheet forces. A substrate feeding system according to the principles of the present invention includes a feeder roll and a retard roll that form a nip, a nudger roll for advancing a substrate toward the nip, and a pre-shingling and anti-jamming entrance guide between the nudger roll and the nip. The entrance guide is comprised of a contact surface that forms an angle of more than 100° with the direction of motion of the substrate. The entrance guide further including a top section over which the substrate moves as it advances into the nip. The entrance guide is beneficially pivotally mounted such that when a retard roll is removed the entrance guide pivots out of the way, and such that when a retard roll is in place the entrance guide moves into position.

Pursuant to another aspect of the present invention, there is provided an electrophotographic printing machine having a sheet feeder having a substrate feeding system for feeding substrates from a substrate stack toward an electrophotographic printing station. The substrate feeding system includes a feeder roll and a retard roll that form a nip, a nudger roll for advancing a substrate from the substrate stack toward the nip, and a pre-shingling and anti-jamming entrance guide between the nudger roll and the nip. The entrance guide is comprised of a contact surface that forms an angle of more than 100° with the direction of motion of the substrate. The entrance guide further including a top section over which the substrate moves as it advances into the nip. The entrance guide is beneficially pivotally mounted such that when the retard roll is removed the entrance guide pivots out of the way, and such that when the retard roll is in place the entrance guide moves into position. The electrophotographic printing station further includes a transfer station for transferring a marking material onto a substrate that is advanced by the substrate feeding system.

BRIEF DESCRIPTION OF THE DRAWINGS

Other aspects of the present invention will become apparent as the following description proceeds and upon reference to the following drawings, in which like reference numerals identify like elements and wherein:

FIG. 3 is a perspective view of the inventive substrate feeding system; and

FIG. 4 is a perspective view of the entrance guide used in the substrate feeding system of FIG. 3.

DETAILED DESCRIPTION OF A PREFERRED EMBODIMENT OF THE INVENTION

Figure 1:
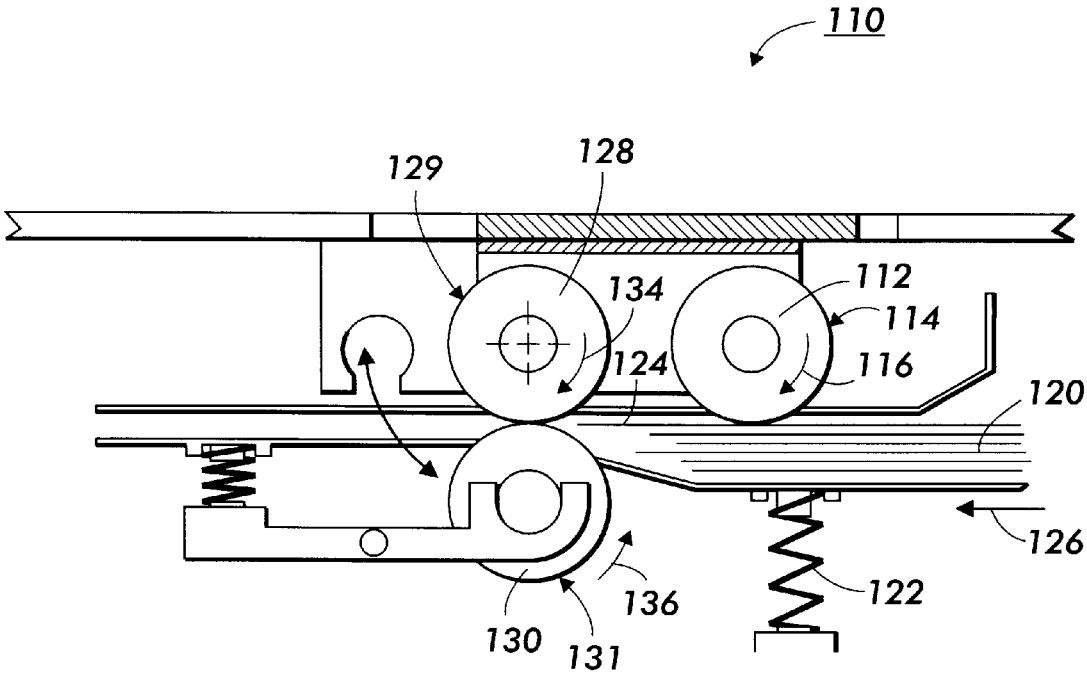
FIG. 1 PRIOR ART
FIG. 1 shows a prior art substrate feeding system.
Figure 2:
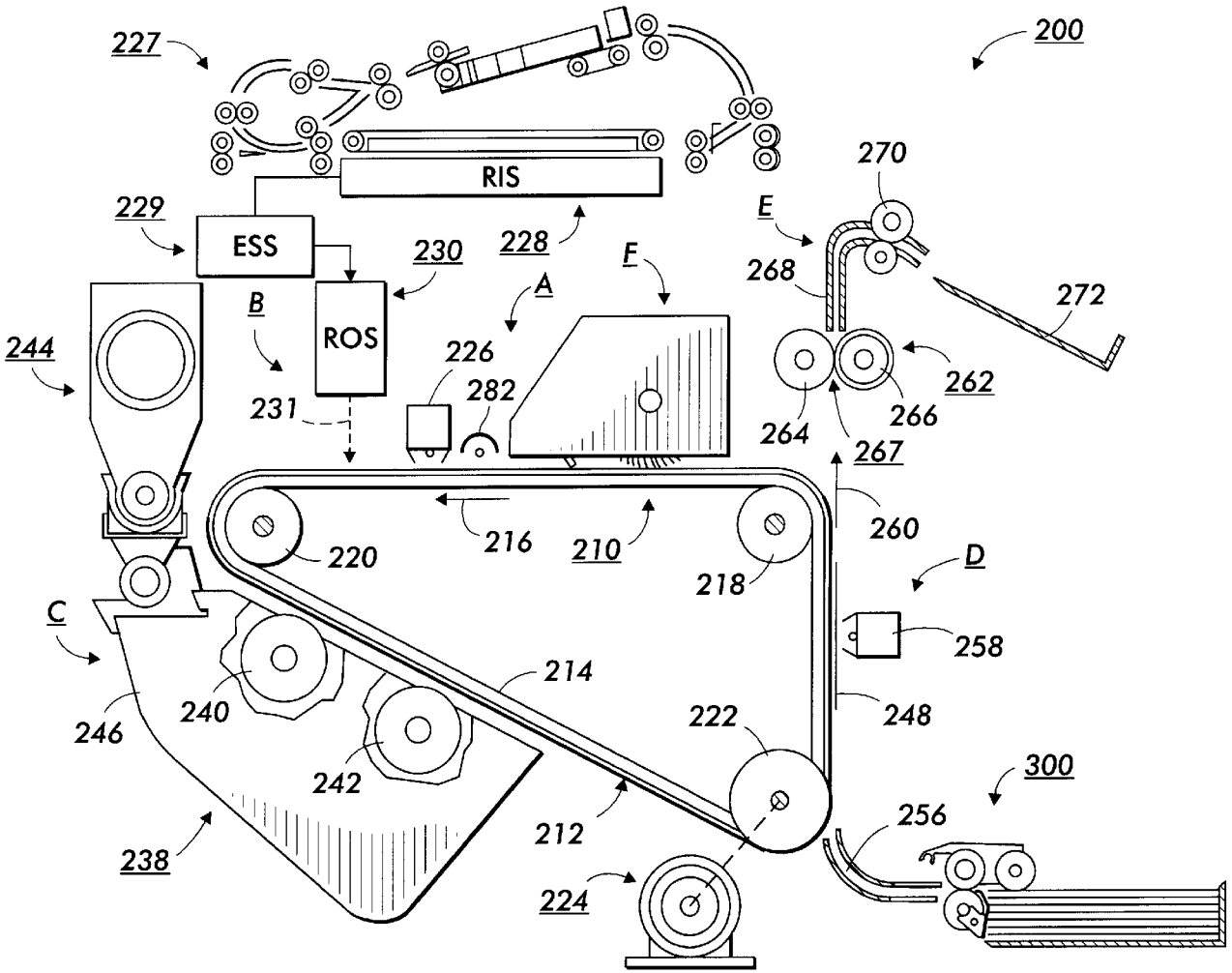
FIG. 2 is a schematic view of an electrophotographic marking machine that includes an inventive substrate feeding system.

Refer now to FIG. 2 wherein a preferred embodiment of the present invention, a digital copier 200, is implemented.

In operation, an original document is positioned in a document handler 227 of a raster input scanner 228. The raster input scanner contains document illumination lamps, optics, a mechanical scanning drive, and a charge coupled device (CCD) array. The raster input scanner captures the entire original document and converts it to a series of raster scan lines. This information is transmitted to an electronic subsystem 229, which also controls a raster output scanner 230 described below.

The digital copier further includes an electrophotographic printing machine which generally employs a belt 210 having a photoconductive surface 212 deposited on a conductive ground layer 214. The belt 210 moves in the direction 216 so as to advance successive portions of the photoconductive surface 212 sequentially through the various processing stations disposed about the belt. The belt 210 is entrained about a stripping roll 218, a tensioning roll 220 and a drive roll 222. The drive roll 222 is rotated by a motor 224 and advances the belt 210 in the direction 216.

Initially, a portion of the belt 210 passes through a charging station A. There a corona generating device 226 charges the photoconductive surface 212 to a relatively high, substantially uniform potential. After the photoconductive surface is charged, the charged portion is advanced through an exposure station B.

At exposure station B the electronic subsystem 229, beneficially a dedicated minicomputer, causes the raster output scanner 230 to produce a modulated laser beam 231. The raster output scanner includes a rotating, multi-faceted polygon mirror and optical systems that sweep the modulated laser beam as a light spot across the photoconductive surface. The sweeping of the laser beam 231 together with the advancement of the belt in the direction 216 cause the charged photoconductive surface to be raster scanned with the modulated laser beam, thereby recording an electrostatic latent image. The electronic subsystem 229 controls the laser beam modulation such that an electrostatic latent image of a desired image is produced.

After being recorded, the electrostatic latent image advances to a development station C. There, toner, in the form of liquid or dry particles, is electrostatically deposited on the electrostatic latent image using well known techniques. Preferably, the development station C uses a magnetic brush developer 238 having magnetic brush developer rolls 240 and 242. Those rolls form a brush of carrier granules and toner particles that extend near the photoconductive surface. The latent image attracts toner particles from the carrier granules, forming a toner powder image. The magnetic brush developer further includes a toner particle dispenser 244 that dispenses toner particles into a developer housing 246 as required.

After the electrostatic latent image is developed, the toner powder image advances to a transfer station D. Additionally, a substrate 248, such as a sheet of paper, is also advanced to the transfer station D via a substrate feeding apparatus 300, which is described in more detail subsequently. The substrate 248 travels along a chute 256, which directs the substrate into contact with the photoconductive surface 212. Substrate advancement is timed such that the substrate 248 overlaps the toner powder image as the belt advances. The transfer station D includes a corona generating device 258 that sprays ions onto the back side of the substrate 248. This causes toner to transfer from the photoconductive surface 212 onto the substrate 248. After transfer, the substrate 248 advances in the direction 260 into a fusing station E.

The fusing station E includes a fuser assembly 262 that permanently affixes the transferred toner to the substrate 248. The fuser assembly 262 includes a heated fuser roll 264 and a back-up roll 266 that form a nip 267. The substrate 248 passes between the fuser roll 264 and the back-up roll 266 such that the toner contacts the fuser roll 264. Heat and pressure in the nip permanently affix the toner to the substrate 248. After fusing, the substrate advances through a chute 268 and a drive roll assembly 270 to catch tray 272 for subsequent removal by the operator.

After the substrate separates from the photoconductive surface 212 there may be residual toner, paper fibers, or other debris remaining on the photoconductive surface 212. Such debris is removed at a cleaning station F. After cleaning a discharge lamp 282 floods the photoconductive surface 212 with light to dissipate any residual electrostatic charges in preparation for the next imaging cycle.

The subject invention is most directly related to the substrate feeding apparatus 300. FIG. 3 shows the substrate feeding apparatus 300 in more detail. The substrate feeding apparatus includes a nudger roll 302 having a high friction surface 303 for moving a topmost substrate 248 from a substrate stack 304 in the direction 306. Movement in the direction 306 causes the substrate to contact an entrance guide 310. The entrance guide pre-shingles the substrate 248 (and thus reduces jamming). That is, the topmost substrate 248 may be attached in some manner to another substrate. When the topmost substrate 248/attached substrate contact the entrance guide 310 the substrates buckle slightly, which tends to break the attachment between the substrates. Further advancement by the nudger roll causes the topmost substrate 248 to separate from its formally attached substrate. Further advancement by the nudger roll causes the topmost substrate to advance over the entrance guide into a nip 311 formed by a feed roll 312 having a high friction surface 313 and a retard roll 314 having a high friction surface 315. The feed roll and retard roll further separate any attached substrates from the topmost substrate 248 as described in the "Background of the Invention." The topmost substrate is advanced by the feed roll toward the transfer station (described above).

Turning now to FIG. 4, the entrance guide 310 is beneficially comprised of a bent piece of relatively flat stainless steel that is somewhat wider than the retard roll. This width seems to give the best overall performance with currently available grades of paper. However, experimentation may be required to optimize performance. The entrance guide includes a top section 320 that directs the topmost substrate into the nip 311, an angled contact section 322 that first contacts the topmost substrate 248, a pivot arm 324, and a pivot mount 326. The pivot mount includes a curved contact surface 328 for contacting the shaft 330 of the retard roll (shown in FIG. 3). Referring now to FIGS. 3 and 4, the entrance guide 310 pivots on a stud 334 of the pivot mount 326 such that when the retard roll 314 is in its operational position the shaft 330 forces the top section 320 near the nip 311. This position of the entrance guide is shown in solid lines in FIG. 3. However, when the retard roll is removed, such as during replacement, gravity causes the entrance guide to pivot such that the top section 320 moves away from the nip and thus out of the way. This position of the entrance guide is shown in broken lines in FIG. 3.

With the top section 322 in its operating position, the angle between the topmost substrate 248 when it first contacts the entrance guide and the angled contact section 322 is beneficially 126°±5°. This range seems to give the best overall performance with currently available grades of paper. However, experimentation to find the best angle for various substrates may be required to optimize performance.

It is to be understood that while the figures and the above description illustrate the present invention, they are exemplary only. Others who are skilled in the applicable arts will recognize numerous modifications and adaptations of the illustrated embodiments that will remain within the principles of the present invention.

What is claimed:

1. A substrate feeding apparatus for feeding substrates from a substrate stack, comprising:

a nudger roll for advancing a first substrate from the substrate stack;

a feed roll for further advancing said first substrate;

a retard roll forming a nip with said feed roll, said retard roll for separating said first substrate from an adjacent second substrate; and an entrance guide disposed between said nudge roll and said nip, said entrance guide having an elongated contact section for contacting said first substrate as it advances from the nudge roll to said nip such that said first substrate buckles slightly so that the attachment between said first substrate and said second substrate is reduced, wherein said contact section forms an angle greater than 100° with the first substrate.

2. An apparatus according to claim 1, wherein said entrance guide includes a top section that guides said first substrate into said nip.

3. An apparatus according to claim 1, wherein said entrance guide is pivotally mounted, wherein said retard roll is removable, and wherein said entrance guide is pivoted toward said nip when said retard roll is in place, and wherein said entrance guide pivots away when said retard roll is removed.

4. An apparatus according to claim 3, wherein said retard member is mounted on a shaft, and wherein said shafts causes said entrance guide to pivot forward when said retard roll is in place.

5. An apparatus according to claim 4, wherein said entrance guide includes a curved surface for contacting said shaft.

6. A printing machine having a substrate feeder comprised of:

a nudger roll for advancing a first substrate from the substrate stack;

a feed roll for further advancing said first substrate;

a retard roll forming a nip with said feed roll, said retard roll for separating said first substrate from an adjacent second substrate; and an entrance guide disposed between said nudge roll and said nip, said entrance guide having an elongated contact section for contacting said first substrate as it advances from the nudge roll to said nip such that said first substrate buckles slightly so that the attachment between said first substrate and said second substrate is reduced, wherein said contact section forms an angle greater than 100° with the first substrate.

7. A printing machine according to claim 6, wherein said entrance guide includes a top section that guides said first substrate into said nip.

8. A printing machine according to claim 6, wherein said entrance guide includes a curved surface for contacting said shaft.

9. A printing machine according to claim 6, wherein said entrance guide is pivotally mounted, wherein said retard roll is removable, and wherein said entrance guide is pivoted toward said nip when said retard roll is in place, and wherein said entrance guide pivots away when said retard roll is removed.

10. A printing machine according to claim 9, wherein said retard member is mounted on a shaft, and wherein said shafts causes said entrance guide to pivot forward when said retard roll is in place.

11. A substrate feeding apparatus for feeding substrates from a substrate stack, comprising:

a nudger roll for advancing a first substrate from the substrate stack;

a feed roll for further advancing said first substrate;

a shaft mounted, removable retard roll forming a nip with said feed roll, said retard roll for separating said first substrate from an adjacent second substrate; and a pivotally mounted entrance guide disposed between said nudge roll and said nip, said entrance guide having an elongated contact section for contacting said first substrate as it advances from the nudge roll to said nip such that said first substrate buckles slightly so that the attachment between said first substrate and said second substrate is reduced, wherein said shaft causes said entrance guide to pivot toward said nip when said retard roll is in place, and wherein said entrance guide pivots away when said retard roll is removed.

12. An apparatus according to claim 11, wherein said entrance guide includes a top section that guides said first substrate into said nip.

13. An apparatus according to claim 11, wherein said contact section forms an angle of greater than 100° with said first substrate when said first substrate contacts said contact section.

14. An apparatus according to claim 11, wherein said entrance guide includes a curved surface for contacting said shaft.

15. A printing machine having a substrate feeder comprised of:

a nudger roll for advancing a first substrate from the substrate stack;

a feed roll for further advancing said first substrate;

a shaft mounted, removable retard roll forming a nip with said feed roll, said retard roll for separating said first substrate from an adjacent second substrate; and a pivotally mounted entrance guide disposed between said nudge roll and said nip, said entrance guide having an elongated contact section for contacting said first substrate as it advances from the nudge roll to said nip such that said first substrate buckles slightly such that the attachment between said first substrate and said second substrate is reduced, wherein said shaft causes said entrance guide to pivot toward said nip when said retard roll is in place, and wherein said entrance guide pivots away when said retard roll is removed.

16. A printing machine according to claim 15, wherein said entrance guide includes a top section that guides said first substrate into said nip.

17. A printing machine according to claim 15, wherein said contact section forms an angle of greater than 100° with the direction of motion said substrate when said substrate contacts said contact section.

18. A printing machine according to claim 15, wherein said entrance guide includes a curved surface for contacting said shaft.

* * * * *